US007952008B2

(12) United States Patent
Walter

(10) Patent No.: US 7,952,008 B2
(45) Date of Patent: May 31, 2011

(54) MUSICAL PERCUSSION INSTRUMENT

(75) Inventor: Claude Walter, Illkirch-Graffenstaden (FR)

(73) Assignee: Rythmes & Sons (Societe A Responsabilite Limitee), Illkirch-Graffenstaden (FR)

( * ) Notice: Subject to any disclaimer, the term of this patent is extended or adjusted under 35 U.S.C. 154(b) by 116 days.

(21) Appl. No.: 12/439,664

(22) PCT Filed: Sep. 7, 2007

(86) PCT No.: PCT/FR2007/051890

§ 371 (c)(1), (2), (4) Date: Apr. 3, 2009

(87) PCT Pub. No.: WO2008/029067

PCT Pub. Date: Mar. 13, 2008

(65) Prior Publication Data

US 2010/0005947 A1 Jan. 14, 2010

(30) Foreign Application Priority Data

Sep. 8, 2006 (FR) ..... 06 53628

(51) Int. Cl.
*G10D 13/02* (2006.01)

(52) U.S. Cl. ..... 84/411 R

(58) Field of Classification Search ..... 84/411 R, 84/421

See application file for complete search history.

(56) References Cited

U.S. PATENT DOCUMENTS

| | | | | |
|---|---|---|---|---|
| 3,620,118 | A | 11/1971 | Koishikawa | |
| 3,647,931 | A | 3/1972 | Koishikawa | |
| 6,576,829 | B1 * | 6/2003 | Hart | 84/737 |
| 2007/0251373 | A1 * | 11/2007 | Fadda | 84/411 R |

FOREIGN PATENT DOCUMENTS

WO WO 2004/015681 A 2/2004

* cited by examiner

*Primary Examiner* — Kimberly R Lockett
(74) *Attorney, Agent, or Firm* — Egbert Law Offices PLLC

(57) ABSTRACT

The invention relates to a musical percussion instrument including a barrel and a membrane, being stretched over at least one of the openings and being in the form of a disc of appropriate material. The membrane has a device to collaborate with a complementary device of the barrel or a support to allow the membrane to be attached to the barrel with the application of tension. This musical instrument is characterized in that the membrane is equipped with devices defined by a series of holes, uniformly distributed at the periphery of the disc and through which a series of ties are intended to be anchored, at least part of the ties being capable of being secured to an element that forms an integral part of the barrel or of a support thereof.

19 Claims, 1 Drawing Sheet

MUSICAL PERCUSSION INSTRUMENT

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

This invention relates to a musical percussion instrument such as a tom-tom, drum or the like, comprising a barrel over which a membrane is stretched.

This invention concerns the field of the manufacture of musical percussion instruments, and more specifically of those the sound emission of which results from striking or scratching a membrane stretched over a resonance chamber.

2. Description of Related Art Including Information Disclosed Under 37 CFR 1.97 and 37 CFR 1.98

Whether it is traditionally obtained from an animal skin, or, for modern percussion instruments, made out of a synthetic material, such a membrane is, classically, in the form of a disc capable of being equipped with means designed to permit its mounting, by applying tension, on a barrel adopting, generally, the shape of a cylindrical element open at its two ends, serving as the instrument's resonance chamber.

A type of membrane commonly used nowadays consists of a film of a synthetic material, such as Mylar™ (registered trademark of the company Du Pont de Nemours), shaped so as to offer a plane circular surface extended, on its circumference, by a curved goffered edge the external border of which is, classically, crimped in a strapping formed so as to define a shoulder extending all around the external face of said edge. Therefore, such a membrane has a substantially Ω-shaped section. This membrane, more specifically its central circular plane surface, is designed to be placed over an opening of the barrel, whereas the strapping this membrane includes is designed to receive a ring, placed over said shoulder, and made integral with the barrel or with a support thereof, by means of ties or the like capable of fastening said membrane and of stretching the latter over said barrel.

These ties are, classically, defined by a plurality of screws, passing through holes uniformly arranged at the level of the ring, and capable of being inserted and screwed on more or less deeply into orifices provided for on the barrel or on the support thereof. The handling of these screws by a user permits, besides the simple fastening of the membrane on the barrel, to also perform the adjustment of the tension of the membrane, necessary to obtain the expected sound from the instrument. This modification of the tension of the membrane is explained by the fact that a variation of the tightening of the screws corresponds, according to the case, to an intensification or a reduction of the pressure exerted by the ring on the shoulder of the strapping in which the external border of the edge of the membrane is crimped. Thus, the latter, also resting on the opening of the barrel at the level of the periphery of its central plane area, is then, for each tightening or loosening of the ring, respectively stretched or slackened with respect to this opening.

Being able to provide a percussionist with the possibility of placing himself, on his instrument, the membrane of his choice and, if need be, of replacing the latter as often as necessary with another membrane, for example in order to obtain a different tone, indisputably offers a practical advantage and a freedom of action.

Nevertheless, it was found out during utilization that the adjustment of the tension of the membranes of this kind on the barrel proves to be often an operation that is very delicate and tedious to perform, the re-tightening of the screws being generally carried out in a hazardous way, by trial and error. Thus, there is often a problem of load recovery, and of tension not uniformly distributed over the membrane, which can sometimes lead to deterioration of the latter, and making it difficult to obtain a harmonious sound.

On the other hand, membranes of this kind have the disadvantage of requiring numerous manufacturing stages, in particular for making the goffering of the edge and its crimping in the strapping, which finally affects the cost price of the instrument equipped with same.

BRIEF SUMMARY OF THE INVENTION

Therefore, the aim of this invention is to cope with these various disadvantages by providing a musical percussion instrument equipped with a new type of membrane, the adjustment of the tension of which on the barrel is obtained quickly and easily without risking damaging its integrity, and the manufacturing method of which is particularly basic and, hence, inexpensive.

To this end, the invention relates to a musical percussion instrument of the type comprising a barrel over at least one of the openings of which is stretched a membrane in the form of a disc of an appropriate material equipped with means capable of cooperating with complementary means, which the barrel or a support thereof is equipped with, and designed to allow the membrane to be attached to the barrel with the application of tension, wherein said means, which the membrane is equipped with, are defined by a series of holes, uniformly distributed at the level of the periphery of said disc, and in which a series of ties are intended to be anchored, at least part of the ties being capable of being secured to an element that forms an integral part of the barrel or of a support thereof.

Such a conformation of the membrane advantageously permits to distribute, straightaway and uniformly, the tensile forces exerted by the user for the purpose of stretching it during its placement on the barrel. Therefore, problems connected with possible deterioration of the membrane and difficult tuning of the instrument are thus solved.

On the other hand, goffering and crimping stages inherent to the manufacturing of the membranes used for the state-of-the-art musical instruments are eliminated, which also advantageously permits to reduce the cost price of the instruments according to this invention.

According to a preferred embodiment of this invention, the ties are, at least partially, defined by a series of studs distributed uniformly at the level of a ring face (more specifically of an annular disc) the outer diameter of which is at least equal to that of the membrane. The studs are capable of being anchored each in one of the holes the membrane includes and are associated to additional elements for attaching, with application of tension, the membrane to the barrel or to a support.

In this case, the additional elements for attaching, with application of tension, the membrane to the barrel are, preferably, defined by screws uniformly inserted between said studs, capable of being inserted into one of the holes of the membrane and screwed on more or less deeply in complementary orifices provided for this purpose at the level of an integral part of the barrel or at the level of a support of this barrel.

Further aims and advantages of this invention will become clear from the following description referring to embodiments given only indicatively and not restrictively.

BRIEF DESCRIPTION OF THE SEVERAL VIEWS OF THE DRAWINGS

The comprehension of this description will be facilitated by referring to drawings attached hereto.

DETAILED DESCRIPTION OF THE INVENTION

Figure 1:
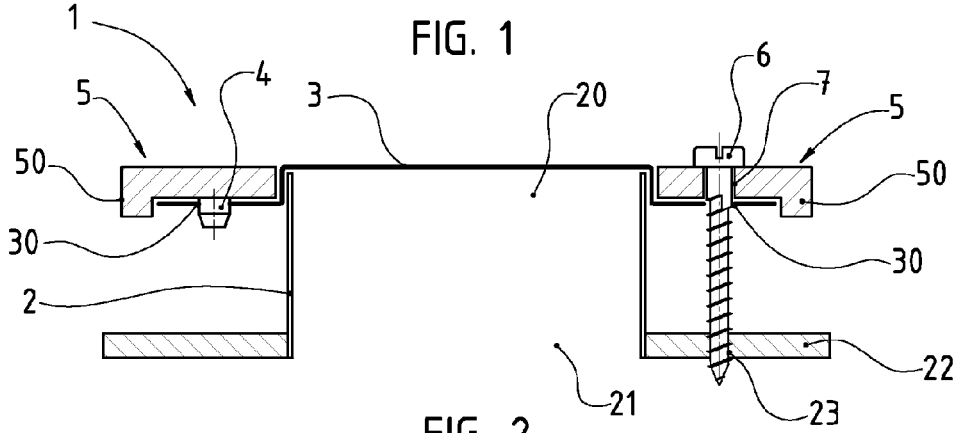
FIG. 1 corresponds to a cross-sectional view of a preferred embodiment of a musical instrument object of this invention.
Figure 2:
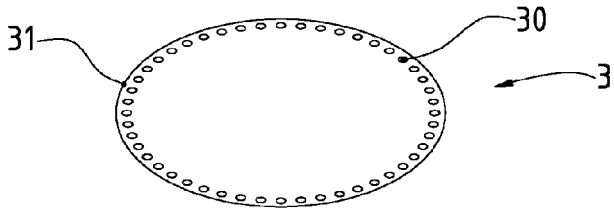
FIG. 2 corresponds to a perspective view of a membrane designed to equip a musical percussion instrument according to this invention.

This invention concerns the field of musical percussion instruments 1 such as a tom-tom, drum or the like. Such a musical instrument 1 includes a resonance chamber, classically defined by an element referred to as barrel 2, in the form of a hollow tube.

In this connection, it should be noted that, in the following part of the description, it will be referred, essentially, to a barrel 2 having a cylindrical shape, considering that this invention is not limited at all to this shape and that such a barrel 2 can, also, adopt an ovoid, elliptic, polygonal (in particular pentagonal, hexagonal, heptagonal, octagonal, decagonal or other) shape or the like.

On the other hand, and in a well-known manner, such a barrel 2 has, at the level of its ends, two openings 20, 21 among which, more specifically and according to the orientation of the barrel 2, an upper opening 20 and a lower opening 21.

Over at least one 20 of these openings 20, 21 is stretched, through appropriate means, a membrane 3, generally in the form of a disc, the striking or scratching of which leads to obtaining a sound. It is known that the latter is not only determined by the material, the size and the shape of the barrel 2, but also by the degree of tension of the membrane 3.

The aim of the invention is to provide a musical percussion instrument 1 in which the membrane 3 is easily interchangeable, while avoiding the problems related to difficult adjustment of the tension and possible deterioration occasionally occurring with the state-of-the-art instruments, as mentioned above. Another aim of the invention is to reduce also the cost price of such a musical instrument 1, by avoiding some manufacturing difficulties.

To this end, the musical instrument 1 according to the invention includes a membrane 3 in the form of a disc equipped with means capable of cooperating with complementary means equipping the barrel 2 or a support 22 the latter 2 includes or associated to the latter 2, more specifically for receiving (in particular by interlocking) such a barrel 2 as shown in FIG. 1. Such complementary means are, actually, designed to allow the membrane 3 to be attached to the barrel 2 or to its support 22, with application of tension.

According to this invention, the abovementioned cooperation means, which the disc of the membrane 3 is equipped with, are defined by a series of holes 30, uniformly distributed at the level of the periphery 31 of this membrane 3. Ties (defining at least partially the abovementioned complementary fastening means) are designed capable of being inserted and anchored, at least part of the ties being capable of being secured (directly or indirectly) to an element that forms an integral part of the barrel 2 or of a support 22 thereof.

According to another feature of the invention, said musical percussion instrument 1 also includes a ring 5 constituting, at least partially, said complementary fastening means and/or receiving such complementary fastening means.

Such a ring 5 is, more specifically, comprised of an annular disc and has, on the one hand, an outer diameter that is at least equal to, and even greater than, that of the disc of the membrane 3 and, on the other hand, an inner diameter at least slightly greater than the outer diameter of the barrel 2, in order to allow the interlocking of said ring 5 around said barrel 2.

It is, more specifically, this ring 5 that receives said ties and/or at the level of which such ties are defined, as will be described in the following part of the description.

In this connection, and according to an additional feature of the invention, the holes 30 (that the membrane 3 has) and, therefore, the ties (that the ring 5 receives and/or that are defined at the level of this ring 5) are uniformly distributed at the level of the membrane 3, respectively at the level of the ring 5.

Actually, these holes 30 and/or these ties are uniformly distributed angularly at the level of the membrane 3 or of the ring 5. Thus, the angle (with respect to the center of the membrane 3 or of the ring 5) between two holes 30 or two successive ties varies between 4 and 10°, preferably between 5 and 8°, considering that excellent results are obtained for an angle in the range of 6.6°.

Such an embodiment permits, advantageously, to take up, in an appropriate manner, all resultants of traction exerted by said ties on the membrane 3, with the maximum possible efficiency and preserving the integrity of the membrane, even for considerable tensile forces.

Besides, such a distribution of these holes 30 and/or of these ties permits, advantageously, to avoid the creep of the membrane 3 which, because of its disadvantages, required, in the state-of-the-art devices, the utilization of an additional element (more specifically a counter-circle) designed to ensure the gripping of such a membrane 3.

According to a first embodiment, the ties are, at least partially, defined by a series of studs 4, on the one hand, distributed uniformly at the level of a face 50 of said ring 5 and, on the other hand, capable of being each anchored in one of the holes 30 the membrane 3 includes.

Figure 3:
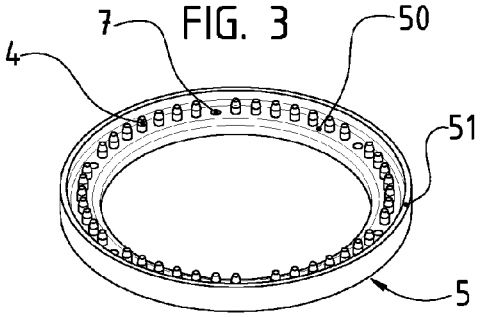
FIG. 3 corresponds to a perspective bottom view of an embodiment of a ring forming part of the structure of the musical instrument represented in FIG. 1.

As shown more specifically in FIG. 3, the studs 4 formed on the ring 5 are defined by parts having a substantially cylindrical shape, the end of which has the shape of a frustum, their diameter corresponding substantially to that of the holes 30 the membrane 3 includes.

Another feature consists in that the holes 30 of the membrane 3 and/or the studs 4 are defined so as to permit the maintaining of the membrane 3 on the ring 5 through the simple insertion of the studs 4 (more specifically of the cylindrical part of such a stud 4) in the holes 30 of this membrane 3.

Actually, and according to another feature of this embodiment, these studs 4 are associated to additional elements for attaching, with application of tension, the membrane 3 to the barrel 2 or to a support 22 associated to the latter 2.

Such additional fastening elements constitute, at least partially, said complementary fastening means and are, preferably, comprised of at least a screw 6 or the like.

Therefore, and according to a first embodiment of the invention (not shown), said ties are comprised of studs 4 distributed uniformly at the level of the face 50 of the ring 5.

The additional fastening elements are then defined by screws screwed on more or less deeply in complementary orifices 23 provided for this purpose at the level of an integral part of the barrel 2 or at the level of a support 22 of said barrel 2 or associated to said barrel 2.

Such screws include or are complemented with means for co-operating with said ring 5, in order to attach, with application of tension, the membrane 3 to the barrel 2 or to a support 22 associated to the latter 2.

In this connection, it should be noted that such cooperation means can be formed of the head of the screw designed to be capable of cooperating with the edge of an orifice made at the level of the ring 5 (in particular along the border or in the periphery of said ring 5), or even of a hitching hook designed to be hitched on the edge of this ring 5.

These additional fastening elements are then, and preferably, installed externally to the membrane 3 and at the periphery or on the border of said ring 5.

More specifically, these additional fastening elements are distributed over a circle of a diameter that is greater than that over which the studs 4 forming the ties are distributed.

According to a preferred embodiment of the invention, described with reference to FIGS. 1, 2, 3 and 4, the ties are, at least partially, defined by a series of studs 4, in this case too distributed uniformly at the level of a face 50 of said ring 5 and anchored, each, in one of the holes 30 the membrane includes 3.

Said studs 2 are associated to additional elements for attaching, with application of tension, the membrane 3 to the barrel 2 or to a support 22 associated to the latter 2.

Figure 4:
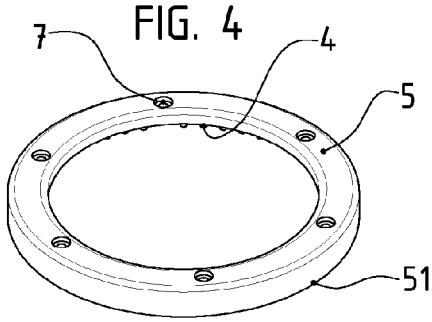
FIG. 4 corresponds to a perspective top view of the ring represented in FIG. 3.

Actually, and according to a preferred embodiment of the invention shown in FIGS. 3 and 4, these additional fastening elements are formed of screws 6 uniformly inserted between said studs 4 (more specifically between two sets of studs) and are inserted, in a through manner, in bores 7 provided for in the ring 5.

In this connection, it should be noted that the number of these screws 6 and the number of these studs 4 respect a specified ratio between them. Actually, this ratio is comprised between 4 through 6 studs 4 per screw 6, preferably 5 studs 4 per such a screw 6.

Such screws 6 are, also, capable of being inserted each in one of the holes 30 of the membrane 3 and can then, here too, form a tie.

These screws 6 are also screwed on, more or less deeply depending on the desired degree of tension, in orifices 23 provided for this purpose on a part of the barrel (2) or at the level of a support 22 said barrel 2 includes, or associated to the latter.

Figure 5:
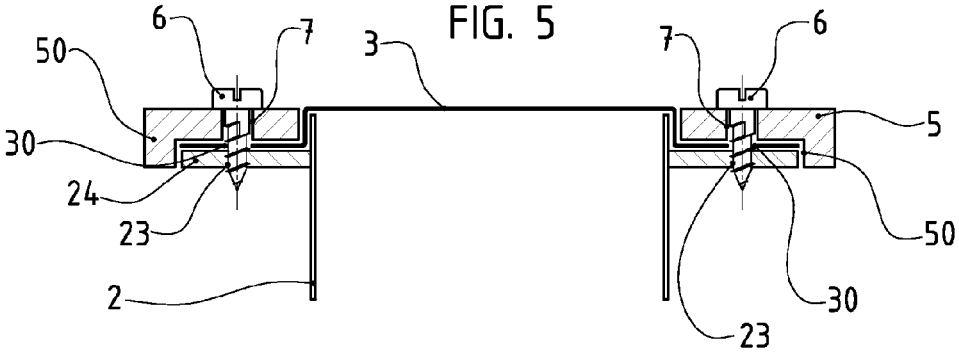
FIG. 5 corresponds to across-sectional view of another embodiment of a musical instrument according to this invention.

According to another alternative embodiment, the screws 6 can also be screwed on onto an element that forms an integral part of the barrel 2, in particular a shoulder 24 or the like that, for example, the musical instrument 1 schematically shown in FIG. 5 includes. This shoulder 24 extends all around the external surface of the barrel 2, near the opening 20 over which said membrane 3 is stretched. It is equipped with orifices 23 capable of receiving the screws 6, which said ring 5, if need be, is equipped with.

FIG. 5 shows a second embodiment of the ties defining, at least partially, the abovementioned complementary fastening means.

Actually, such ties are, at least partially (but preferably entirely), defined by a series of screws 6 distributed (preferably uniformly) at the level of a ring 5 (preferably an annular disc) of the abovementioned type, in particular the outer diameter of which is at least equal to that of the membrane 3.

To this end, said ring 5 includes bores 7, on the one hand, made, preferably uniformly spaced out, at the level of said ring 5 and, on the other hand, each traversed by such a screw 6.

Besides, each one of said screws 6 is capable of being, on the one hand, inserted through one of the holes 30 the membrane 3 includes, and, on the other hand, screwed on more or less deeply in one of the orifices 23 that an integral part (in particular a shoulder 24 of the abovementioned type) of the barrel 2, or, if need be, according to another possibility, a support 22 of the latter 2 includes.

According to another feature of the invention, the ring 5 has a rim 51 extending around its full circumference of the largest diameter. Such a rim 51 forms a skirt permitting to rigidify the ring 5 and/or to occult the presence of the disc of the membrane 3.

Another feature of such a rim 51 consists in that it permits interlocking over a shoulder 24, as shown in FIG. 5.

A preferred embodiment consists in that said rim 51 is made integral with the ring 5.

As regards said ring 5, it can be made of wood but is, preferably, made of synthetic material, in particular by molding or the like. Such an embodiment advantageously permits to make the ring as well as the bores 7, and even the studs 4 and/or the rim 51, in a single operation, in particular molding, for example by extrusion.

As regards said barrel 2, it is made of synthetic material, in particular synthetic resin. A preferred embodiment consists in making such a barrel 2 of translucent or transparent material, more specifically of Plexiglas.

According to additional feature, said membrane 3 can be made of skin, but is, preferably, made of at least one synthetic material, and even of a mixture of synthetic materials, such as carbon, titanium or the like.

I claim:

1. A musical percussion instrument comprising:

a barrel having a first opening and a second opening, said barrel having a support extending outwardly therefrom;

a disc-shaped membrane stretched over said first opening of said barrel, said disc-shaped membrane having a plurality of holes uniformly distributed around an outer periphery thereof;

a ring extending around said first opening, said ring having a plurality of ties thereon, said plurality of ties respectively received in said plurality of holes of said disc-shaped membrane; and at least one fastener connecting said ring to said support of said barrel.

2. The musical percussion instrument of claim 1, said plurality of ties comprising a plurality of studs distributed on a face of said ring, said ring having an outer diameter at least equal to an outer diameter of said disc-shaped membrane, said plurality of studs being respectively received in said plurality of holes.

3. The musical percussion instrument of claim 2, said at least one fastener comprising a plurality of screws cooperative with said ring and screwed into respective complementary orifices on said support.

4. The musical percussion instrument of claim 3, said ring having a plurality of bores formed therethrough, each of said plurality of bores formed between adjacent pairs of said plurality of studs, said plurality of screws extending respectively through said plurality of bores and respective holes of said plurality of holes.

5. The musical percussion instrument of claim 2, each of said plurality of studs having a generally cylindrical shape with an end of a frustum shape, each of said plurality of studs having a diameter substantially equal to a diameter of each of said plurality of holes of said disc-shaped membrane.

6. The musical percussion instrument of claim 1, said plurality of ties comprising a plurality of screws, each of said plurality of screws having a diameter substantially equal to a diameter of each of said plurality of holes of said disc-shaped membrane, said plurality of screws extending through said plurality of holes.

7. The musical percussion instrument of claim 1, said plurality of holes being uniformly distributed on said disc-shaped membrane, each of said plurality of holes being angularly spaced by between 4° and 10° from an adjacent hole of said plurality of holes.

8. The musical percussion instrument of claim 1, said ring having a rim extending around an entire outer circumference thereof.

9. The musical percussion instrument of claim 1, said support of said barrel being a shoulder extending around an exterior surface of said barrel adjacent said first opening of said barrel.

10. The musical percussion instrument of claim 9, said shoulder having orifices formed therein, said orifices receiving the fasteners therein.

11. The musical percussion instrument of claim 1, said ring being formed of wood.

12. The musical percussion instrument of claim 1, said ring being formed of a synthetic material.

13. The musical percussion instrument of claim 1, said barrel having a cylindrical shape.

14. The musical percussion instrument of claim 1, said barrel having an ovoid shape.

15. The musical percussion instrument of claim 1, said barrel being of an elliptical shape.

16. The musical percussion instrument of claim 1, said barrel being of a polygonal shape.

17. The musical percussion instrument of claim 1, said barrel being formed of a synthetic material.

18. The musical percussion instrument of claim 1, said disc-shaped membrane being formed of a skin material.

19. The musical percussion instrument of claim 1, said disc-shaped membrane being formed of a synthetic material.

* * * * *